US007070524B1

(12) United States Patent
Garvey, III

(10) Patent No.: US 7,070,524 B1
(45) Date of Patent: Jul. 4, 2006

(54) WEIGHTED HOCKEY STICK

(76) Inventor: Thomas G. Garvey, III, 299 Old Forks Rd., Hammonton, NJ (US) 08037

( * ) Notice: Subject to any disclaimer, the term of this patent is extended or adjusted under 35 U.S.C. 154(b) by 195 days.

(21) Appl. No.: 10/654,535

(22) Filed: Sep. 2, 2003

(51) Int. Cl.
*A63B 59/14* (2006.01)

(52) U.S. Cl. ..... 473/519; 473/560

(58) Field of Classification Search ..... 473/519, 473/520, 560–563
See application file for complete search history.

(56) References Cited

U.S. PATENT DOCUMENTS

| | | | | |
|---|---|---|---|---|
| 239,796 | A | 4/1881 | Jennings | |
| 3,392,976 | A | 7/1968 | Hayes | |
| 3,834,697 | A | 9/1974 | McNamara, Jr. et al. | |
| 4,364,560 | A | 12/1982 | Gemmel | |
| 4,461,479 | A | 7/1984 | Mitchell | |
| 4,819,935 | A | 4/1989 | Dirksing et al. | |
| 4,989,876 | A | 2/1991 | Hawkins et al. | |
| 4,998,731 | A | 3/1991 | Bowen | |
| 5,135,228 | A | 8/1992 | Hawkins et al. | |
| 5,171,011 | A * | 12/1992 | Squadroni | 473/519 |
| 5,183,264 | A * | 2/1993 | Lanctot | 473/520 |
| 5,609,336 | A * | 3/1997 | Tashjian | 473/560 |
| 6,033,327 | A * | 3/2000 | Bird | 473/560 |
| 6,186,904 | B1 | 2/2001 | Bass | |
| 6,328,666 | B1 | 12/2001 | Manory | |
| 6,432,004 | B1 * | 8/2002 | Nemeckay | 473/519 |
| 6,692,386 | B1 * | 2/2004 | Brundage | 473/457 |

* cited by examiner

*Primary Examiner*—Mark S. Graham
(74) *Attorney, Agent, or Firm*—Norman E. Lehrer

(57) ABSTRACT

A hockey stick that includes an elongated hollow shaft with a bottom end and a top end, at least one weight with apertures formed therethrough, and an elongated metal support that releasably supports the weight thereon. The support is adapted to be inserted within the shaft and extend therethrough. The support includes an elongated metal rod with a top end, a bottom end, an aperture formed in the top end, and a plurality of apertures formed along the length thereof. An end piece is located adjacent the top end of the shaft. The end piece has an aperture formed therethrough. A screw may be inserted through the top aperture of the rod and the aperture of the end piece so that the support is secured within the shaft. A plurality of varying weights may be supported on the elongated metal support at diverse locations along the support.

3 Claims, 2 Drawing Sheets

WEIGHTED HOCKEY STICK

BACKGROUND OF THE INVENTION

The present invention is directed toward a hockey stick and more particularly, toward a weighted hockey stick that may be used by a player to strengthen and exercise various muscles.

Strong wrist muscles, arm muscles, and other muscles used in handling and shooting with a hockey stick are important to a hockey player. Hockey sticks that have weights supported thereon are used during practice sessions in order to strengthen various muscles as well as to improve the player's coordination, timing, and rhythm.

Prior patents have addressed this concern and provide for various weighted hockey sticks. For example, U.S. Pat. No. 4,461,479 to Mitchell discloses a hockey stick with a handle where a weighted insert may be inserted in the handle in order to improve the player's swing. U.S. Pat. No. 6,186,904 to Bass discloses a weighted sport training assembly used to exercise various muscles where the assembly may be used on a hockey stick. The assembly includes a plurality of weights that may be added to the stick. U.S. Pat. No. 6,328,666 to Manory discloses an adjustable hockey stick weight that may be added to the stick wherever the player chooses to use it. U.S. Pat. No. 4,364,560 to Gemmel discloses a U-shaped weight that may be secured anywhere along the length of a hockey stick.

None of these prior patents, however, allows for a plurality of weights to be placed at and secured to various positions along the length of a hockey stick so that several areas of muscles may be exercised simultaneously. Also, none of the prior patents discloses a plurality of weights that may be positioned within the shaft of a practice hockey stick so that the weights are unobtrusive and so that the stick resembles an actual hockey stick that is used during the play of a game. Furthermore, the prior art practice hockey sticks do not provide sufficient flexibility of the stick so as to minimize injury to a player.

SUMMARY OF THE INVENTION

The present invention is designed to overcome the deficiencies of the prior art discussed above. It is an object of the present invention to provide a hockey stick that is weighted and may be used during practice sessions.

It is another object of the present invention to provide a hockey stick that may be used by a player to strengthen and exercise various muscles simultaneously.

It is another object of the present invention to provide a weighted practice hockey stick that allows the number and type of weight to be used to be changed easily, as desired by the player.

It is a further object of the present invention to provide a practice hockey stick that adds a plurality of weights to the stick in an unobtrusive manner so as to simulate an actual hockey stick.

In accordance with the illustrative embodiments demonstrating features and advantages of the present invention, there is provided a weighted hockey stick that includes an elongated hollow shaft with a bottom end and a top end, at least one weight with apertures formed therethrough, means for releasably supporting the weight thereon, the supporting means adapted to be inserted within the hollow shaft and extend therethrough, and means for securing the supporting means to the shaft. Secured to the bottom end of the shaft is a blade. The supporting means may include an elongated metal rod with a top end, a bottom end, apertures formed along the length thereof, and screws that may be inserted through the apertures of the support and the weight. The top end of the shaft is enclosed by an end piece that fits within the top end of the shaft. The securing means may include a screw that is inserted through the metal rod and the end piece and secured thereto. The number, weight and positions of the weights supported on the elongated metal rod may be varied.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and intrumentalities shown.

DETAILED DESCRIPTION OF THE PREFERRED EMBODIMENT

Figure 1:
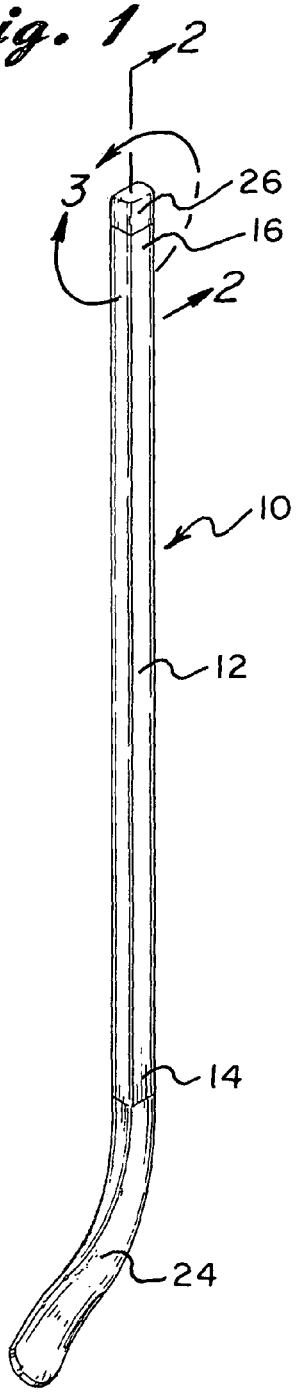
FIG. 1 is a front perspective view of the weighted hockey stick of the present invention.

Referring now to the drawings in detail wherein like reference numerals have been used throughout the various figures to designate like elements, there is shown in FIG. 1 a weighted hockey stick constructed in accordance with the principles of the present invention and designated generally as 10.

The hockey stick of the present invention essentially includes an elongated hollow shaft 12 with a bottom end 14 and a top end 16. Located within the hollow shaft 12 is at least one weight comprised of two sections 18*a* and 18*b* with apertures 20*a*–20*d* formed therethrough releasably secured to an elongated supporting member 22. As can be seen, the weights 18*a*, 18*b* and the supporting member 22 are adapted to be inserted within the hollow shaft 12 and extend the length of the shaft 12. As more fully explained hereinafter, means are provided for securing the supporting member to the shaft 12. The bottom end 14 of the shaft 12 has a blade 24 secured thereto, as typically found in hockey sticks.

Figure 2:
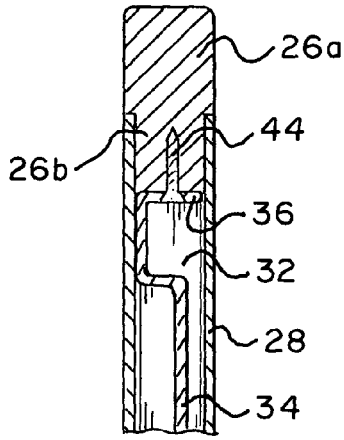
FIG. 2 is a cross-sectional view of the invention taken through line 2—2 of FIG. 1.

The top end 16 of the shaft 12 is enclosed by an end piece 26 that is inserted into the top end 16 of the shaft 12 and fits therein. The end piece 26 includes a top half 26*a* and a bottom half 26*b*. The top half 26*a* lies flush with the outer surface 28 of the shaft 12 when it is inserted within the shaft 12. (See FIG. 1.) The bottom half 26*b* of the end piece 26 is smaller than the top half 26*a* and fits within the top end 16 of the shaft 12. (See FIG. 2.) In this manner, the outer surface 30 of the bottom half 26*b* engages the inner surface 32 of the shaft 12 and is secured therein. Optionally, fastening means, such as a set screw or the like passing through the wall of the shaft and into the bottom half 26*b* of the end piece may be used to secure the end piece to the shaft of the stick.

Figure 4:
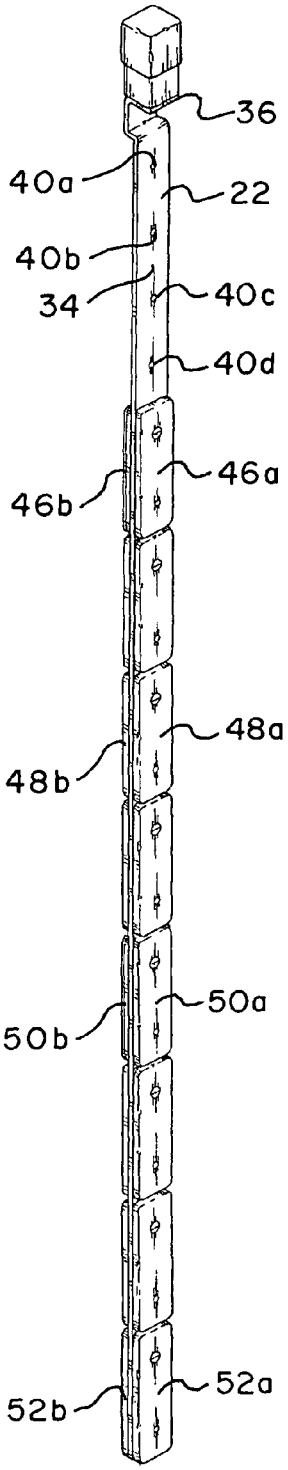
FIG. 4 is a front perspective view of the weights and support rod of the present invention.
Figure 5:
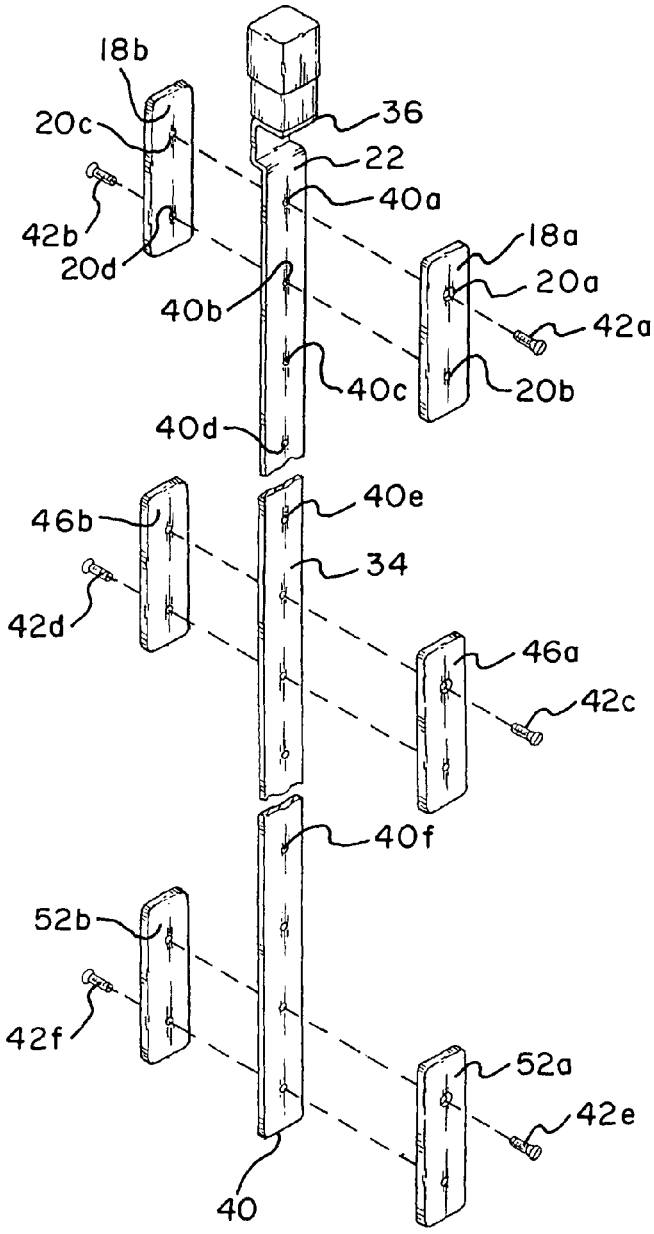
FIG. 5 is an exploded view of the weights and support rod of the present invention.

The supporting means 22 may include an elongated, generally rectangular metal rod 34 with a generally flat horizontal top end 36, a bottom end 38, apertures 40*a*–40*f*, for example, formed along the length thereof, and screws 42*a*–42*f*, for example, that may be inserted through the apertures of the rod 34 and the weight in order to secure the weights 18*a*, 18*b*, 46*a*, 46*b*, 48*a*, 48*b*, 50*a*, 50*b*, and 52*a*, 52*b*, for example, to the rod 34. (See FIGS. 4 and 5.) The weight surrounds the rod so that a first section of the weight is attached to one side of the rod and a second section is attached to the opposite side of the rod. The two sections of the weight are directly opposite to each other. The number, weight and position of the weights supported on the elongated metal rod 34 may be varied. The weights are generally rectangularly shaped metal plates of varying weight. Alternatively, the weights may be attached to the rod via similar types of fasteners known in the art that allow the weights to be easily attached to and removed from the rod. These may include, for example, pins extending from the rod that fit within openings in the weights or vice versa. Alternatively, spring clips or numerous other types of fasteners may be utilized. The only requirement being that any number of weights may be utilized and their position along the length of the rod 34 must be easily adjustable.

The securing means for securing the rod 34 to the shaft 12 may include a screw 44 or similar type of fastening means that is inserted through the top end 36 of the metal rod 34 and the end piece 26 and secured thereto. (See FIG. 2.)

Figure 3:
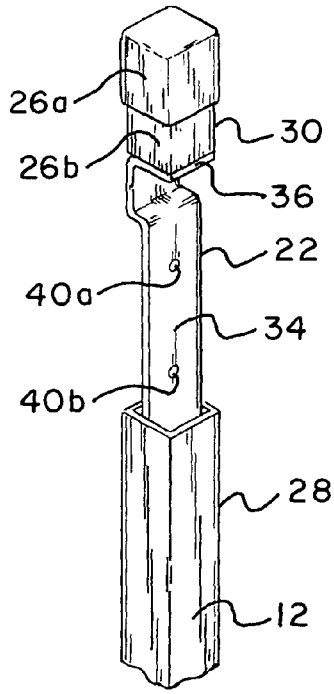
FIG. 3 is an exploded and enlarged view of the invention taken through line 3 of FIG. 1.

In order to use the practice hockey stick of the present invention, upward force is applied to the end piece 26 so that the end piece 26 is disengaged from the shaft 12. The rod 34 may now be pulled out or removed from the shaft 12. Weights 18*a*, 18*b*, 46*a*, 46*b*, and 52*a*, 52*b* for example, can be attached to the rod 34 by inserting screws, shown for example as 42*a*–42*f*, through the apertures of the weight and rod. (See FIGS. 4 and 5.) Any number of weights may be attached to the rod at various locations, depending upon the user's preference. The rod 34 is then placed back into the shaft 12 of the stick. (See FIG. 3.) The rod 34 remains in place within the shaft 12 since the end piece 26 to which the rod 34 is secured fits into the top end 16 of the shaft 12 as described above.

The metal rod may be made from aluminum or similar types of lightweight metal that allows for flexibility of the hockey stick. While metal is preferred, it may also be possible to make the rod 34 from other strong materials such as fiberglass or the like. Gaps between the weights, when they are secured to the metal rod, also allows for flexibility. (See FIG. 4.) The weights may be made from steel, aluminum, or the like.

The present invention may be embodied in other specific forms without departing from the spirit or essential attributes thereof and accordingly, reference should be made to the appended claims rather than to the foregoing specification as indicating the scope of the invention.

I claim:

1. A weighted hockey stick comprising:

an elongated hollow shaft having a top end and a bottom end with a blade secured to said bottom end of said shaft;

an elongated weight supporting member extending within the hollow interior of said shaft;

a plurality of weights and means for releasably securing said weights to said weight supporting member at a variety of different positions along the length of said member, and means for securing said supporting member to said shaft wherein said supporting member includes an elongated metal rod with a top end, a bottom end, apertures formed along the length thereof, and screws that may be inserted through said apertures of said rod and each of said weights to secure each of said weights to said rod.

2. The weighted hockey stick of claim 1 further including an end piece secured to said rod and adapted to be inserted into said top end of said shaft.

3. The weighted hockey stick of claim 2 wherein said securing means includes a screw, an aperture located in said end piece, and an aperture located adjacent said top end of said metal rod, said screw being adapted to be inserted and secured within said top end aperture of said rod and said aperture of said end piece.

* * * * *